US009059497B2

(12) United States Patent
Mi et al.

(10) Patent No.: US 9,059,497 B2
(45) Date of Patent: Jun. 16, 2015

(54) VARIABLE FILTER AND COMMUNICATION APPARATUS

(75) Inventors: Xiaoyu Mi, Kawasaki (JP); Osamu Toyoda, Kawasaki (JP); Satoshi Ueda, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 361 days.

(21) Appl. No.: 13/415,938

(22) Filed: Mar. 9, 2012

(65) Prior Publication Data

US 2012/0229231 A1 Sep. 13, 2012

(30) Foreign Application Priority Data

Mar. 11, 2011 (JP) ..... 2011-054681

(51) Int. Cl.
*H01P 1/203* (2006.01)
*H01P 7/08* (2006.01)

(52) U.S. Cl.
CPC ..... *H01P 1/20327* (2013.01); *H01P 7/088* (2013.01)

(58) Field of Classification Search
CPC ..... H01P 1/20327; H01P 1/20336; H01P 1/2039; H01P 1/203; H01P 1/20354; H01P 7/08; H01P 7/088
USPC ..... 333/33, 134, 167, 175, 186, 202, 204, 333/205, 219, 235, 238, 246, 262, 263
See application file for complete search history.

(56) References Cited

U.S. PATENT DOCUMENTS 6,404,304 B1 6/2002 Kwon et al.
6,483,406 B1 11/2002 Sawa et al.
6,597,265 B2 7/2003 Liang et al.
6,740,613 B2 * 5/2004 Kim et al. ..... 501/134
7,573,356 B2 * 8/2009 Kawai et al. ..... 333/205
7,583,168 B2 * 9/2009 Kawai et al. ..... 333/238

(Continued)

FOREIGN PATENT DOCUMENTS

CN 101030666 9/2007
JP 3762109 1/2006

(Continued)

OTHER PUBLICATIONS www.wordsense.eu : Accessed on Apr. 4, 2014: Definition of the term "Inter-stage".*

(Continued)

*Primary Examiner* — Benny Lee
*Assistant Examiner* — Jorge Salazar, Jr.
(74) *Attorney, Agent, or Firm* — Fujitsu Patent Center

(57) ABSTRACT

A variable filter includes, on a dielectric substrate including ground conductor, first resonator including a transmission line connected to input terminal, second resonator including a transmission line connected to output terminal, and coupling portion including a transmission line having one end connected to the first and second resonators and another end being an open end, or structure having one end connected to the first and second resonators, including a serial connection of a transmission line and a variable capacitor, another end of the variable capacitor connected to the ground conductor, and adjusting means capable of changing electric length, in the first and second resonators and the coupling portion, wherein pass band width can be changed by changing ratio of electric transmission length of the coupling portion to electric transmission lengths of transmission line including the coupling portion, and the first and second resonators.

13 Claims, 5 Drawing Sheets

(56) References Cited

U.S. PATENT DOCUMENTS

| | | | | |
|---|---|---|---|---|
| 8,130,055 | B2 | 3/2012 | Hayashi et al. | |
| 2006/0087388 | A1 | 4/2006 | Kawai et al. | |
| 2008/0266029 | A1 | 10/2008 | Mi et al. | |
| 2009/0027141 | A1 | 1/2009 | Oshima | |
| 2009/0212887 | A1* | 8/2009 | Rofougaran | 333/24 R |
| 2010/0182097 | A1 | 7/2010 | Hayashi et al. | |
| 2010/0237965 | A1 | 9/2010 | Mi et al. | |
| 2010/0295634 | A1 | 11/2010 | Akale | |

FOREIGN PATENT DOCUMENTS

| | | | |
|---|---|---|---|
| JP | 2006-128912 | | 5/2006 |
| JP | 2008-278147 | A | 11/2008 |
| JP | 2009-083018 | | 4/2009 |
| JP | 4550915 | | 7/2010 |
| JP | 2010-220139 | A | 9/2010 |
| JP | 2010-263470 | | 11/2010 |
| WO | WO-02/41441 | A1 | 5/2002 |
| WO | 2008018565 | A1 | 2/2008 |
| WO | WO-2008/088144 | A1 | 7/2008 |

OTHER PUBLICATIONS

Extended European Search Report dated Jul. 20, 2012 for corresponding European Application No. 12158599.6.

D. Peroulis et al, "Tunable Lumped Components with Applications to Reconfigurable MEMS Filters", 2001 IEEE MTT-S Digest, 2001, pp. 341-344.

E. Fourn et al, "MEMS Switchable Interdigital Coplanar Filter", IEEE Trans. Microwave Theory Tech., vol. 51, No. 1, Jan. 2003, pp. 320-324.

A. A. Tamijani et al, "Miniature and Tunable Filters Using MEMS Capacitors", IEEE Trans. Microwave Theory Tech., vol. 51, No. 7, Jul. 2003, pp. 1878-1885.

Notice of Reasons of Rejection, Japanese Office Action [JPOA] dated Jul. 29, 2014, issued in corresponding Japanese Patent Application No. 2011-054681, with Partial English translation.

CNOA—The Second Office Action dated May 14, 2014, for corresponding CN application No. 201210061293.5 with English translation.

CNOA—Third Chinese Office Action dated Aug. 12, 2014, issued in corresponding Chinese Patent Application No. 201210061293.5, with Partial English translation.

JPOA—Notice of Reasons of Rejection, Office Action of Japanese Application No. 2011-054681 dated Dec. 9, 2014. Translation of the relevant part, p. 1, line 1 to p. 2, line 4, of the Office Action.

JPOA-Japanese Office Action; Decision to Dismiss the Amendment issued for Japanese Patent Application No. 2011-054681, mailed on Apr. 28, 2015, with partial English translation.

* cited by examiner

VARIABLE FILTER AND COMMUNICATION APPARATUS

CROSS REFERENCE TO RELATED APPLICATION

This application is based upon and claims the benefit of priority of the prior Japanese Patent Application No. 2011-054681, filed on Mar. 11, 2011, the entire contents of which are incorporated herein by reference.

FIELD OF THE INVENTION

The present invention relates to a variable filter to be used for band pass of a high frequency signal, and a communication apparatus using this filter.

BACKGROUND OF THE INVENTION

A market of mobile communication including portable phones is expanding, and high performance of its service is under progress. As frequency band used by mobile communication gradually shifts to a frequency band higher than giga hertz (GHz), there is a tendency for mobile communication to become multi-channel. A possibility of future introduction of software radio (SDR: software-defined-radio) is being studied vigorously. In order to realize software radio, a wider adjustment range of circuit characteristics is desired.

FIG. 4 is a circuit diagram of a conventional frequency variable filter 100*j*. The variable frequency filter 100*j* has a plurality of channel filters 101*a*, 101*b*, 101*c* . . . , and switches 102*a* and 102*b*. By switching the switches 102*a* and 102*b*, any one of the channel filters 101*a*, 101*b*, and 101*c* . . . is selected to change the frequency band. A high frequency signal input from an input terminal 103 is filtered by the selected channel filter 101 and is output from an output terminal 104.

The frequency variable filter 100*j* has channel filters corresponding in number to the number of channels. A multi-channel increases the number of channel filters, complicates the structure, and increases the size and cost. A possibility of realizing SDR is small.

Attention has been paid recent years to a compact micro machine device using MEMS (micro electro mechanical systems). An MEMS device (micro machine device) using MEMS is able to have a high Q (quality factor) and be applied to a high frequency band variable filter (Patent Documents 1 and 2, Non-Patent Documents 1, 2, and 3). Since an MEMS device is compact and has a low loss, it is often used for a CPW (coplanar waveguide) distributed constant resonator.

Non-Patent Document 3 discloses a filter having the structure that a plurality of variable capacitors of MEMS devices ride over a three-stage distributed constant line. In this filter, a control voltage Vb is applied to a drive electrode of a MEMS device to displace a variable capacitor, change a gap to a distributed constant line, and change an electrostatic capacitance. Change in the electrostatic capacitance changes the pass band of the filter.

[Patent Document 1] JP-A-2008-278147

[Patent Document 2] JP-A-2010-220139

[Non-Patent Document 1] D. Peroulis et al, "Tunable Lumped Components with Applications Reconfigurable MEMS Filters", 2001 IEEE MTT-S Digest, p 341-344

[Non-Patent Document 2] E. Fournet et al, "MEMS Switchable Interdigital Coplanar Filter", IEEE Trans. Microwave Theory Tech., vol. 51, No. 1 p 320-324, January 2003

[Non-Patent Document 3] A. A. Tamijani et al, "Miniature and Tunable Filters Using MEMS Capatitors", IEEE Trans. Microwave Theory Tech., vol. 51, No. 7, p 1878-1885, July 2003

SUMMARY OF THE INVENTION

Although a conventional filter is able to make variable the center frequency of a pass band, it is not able to change largely a pass band width.

According to one aspect, a variable filter includes:

a dielectric substrate having a ground conductor therein;

an input terminal formed on the dielectric substrate;

an output terminal formed on the dielectric substrate;

a first resonator including a transmission line whose one end is connected to the input terminal;

a second resonator including a transmission line whose one end is connected to the output terminal;

a coupling portion including a transmission line whose one end is connected to other ends of the first and second resonators and whose another end is an open end, or a structure whose one end is connected to other ends of the first and second resonators, including a serial connection of a transmission line and a variable capacitor, another end of the variable capacitor being connected to the ground conductor; and adjusting means capable of changing an electric length, in the first and second resonators and the coupling portion;

wherein a pass band width is able to be changed by changing a ratio of electric transmission length of the coupling portion to electric transmission lengths of transmission line including the coupling portion, and the first and second resonators.

The object and advantages of the invention will be realized and attained by means of the elements and combinations particularly pointed out in the claims.

It is to be understood that both the foregoing general description and the following detailed description are exemplary and are not restrictive of the invention, as claimed.

DESCRIPTION OF THE PREFERRED EMBODIMENTS

Figure 1A:
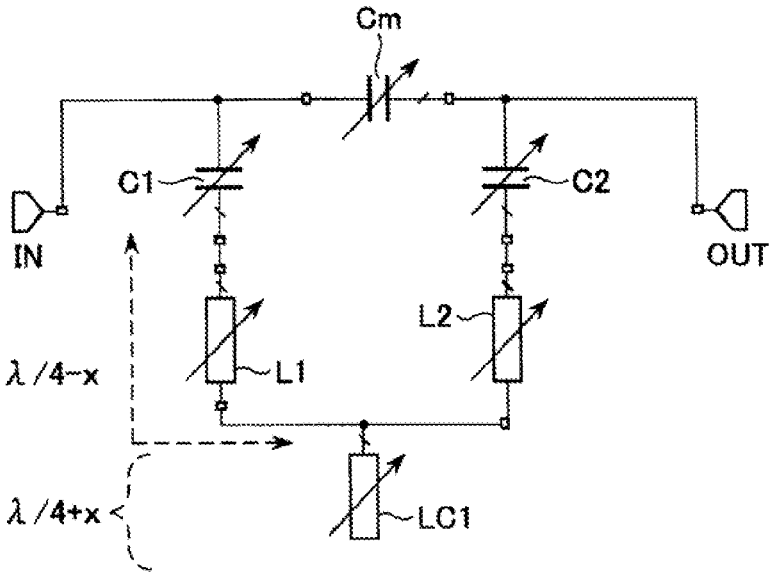
FIG. 1A is an equivalent circuit diagram of a variable filter of the first embodiment.

FIG. 1A is an equivalent circuit diagram of a variable filter of the first embodiment. Serial connection of a first variable capacitor C1 and a distributed constant type first variable transmission line L1 is connected to an input terminal IN, serial connection of a second variable capacitor C2 and a distributed constant type second variable transmission line L2 is connected to an output terminal OUT, and a distributed constant type third variable transmission line LC1 is connected as a coupling portion to the other ends of the transmission lines L1 and L2. It can also be said that as viewed from the coupling portion of the transmission line LC1, a first branch portion of the transmission line L1 and a second branch portion of the transmission line L2 are connected by using one end of the transmission line LC1 as a coupling portion, and the other end of the transmission line LC1 is an open end. An inter-stage variable capacitor Cm is connected between the input terminal IN and output terminal OUT, although this capacitor is not an indispensable component. The transmission lines L1, L2, and LC1 constitute resonators having variable electric lengths. The variable filter is formed on a dielectric substrate such as an LTCC (low temperature co-fired ceramics).

The variable capacitors C1 and C2 are able to provide impedance matching with external. The inter-stage variable capacitor Cm forms attenuation poles on both sides of the pass band to make steep the shape of the pass band. The electric lengths of the first variable transmission line L1, second variable transmission line L2, and coupling portion variable transmission line LC1 are $(\lambda/4)-x$, $(\lambda/4)-x$, and $(\lambda/4)+x$, respectively. The variable filter passes a high frequency signal having a wave length of $\lambda$ from the input terminal IN to output terminal OUT.

A high frequency signal input from the input terminal IN passes through an impedance adjusting capacitor C1, thereafter propagates to the transmission line L1 of the first branch portion, and the transmission line LC1 of the coupling portion, and is reflected at the open end of the transmission line LC1. The reflected high frequency signal propagates the transmission line LC1 reversely, and reenters the transmission line L1 from the coupling portion. The reentered high frequency signal is reflected at the C1 side end of the first transmission line L1 to propagate the transmission line L1 reversely. Namely, the state similar to the initial state resumes. Similar operations are repeated thereafter. At least a portion of the high frequency signal propagates the transmission line LC1 reversely enters the second transmission line L2 of the second branch portion. If the transmission lines have the above-described electric lengths, almost all the high frequency signal having a wave length of $\lambda$ is supplied to the second transmission line.

Figure 1B:
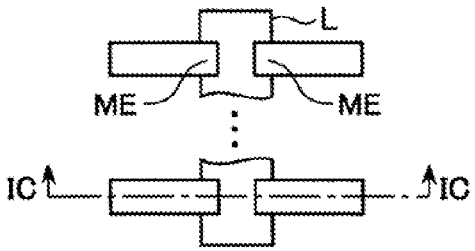
FIGS. 1B and 1C are a top view and a cross sectional view of an example of a variable distributed constant type transmission line with MEMS variable capacitors.
Figure 1C:
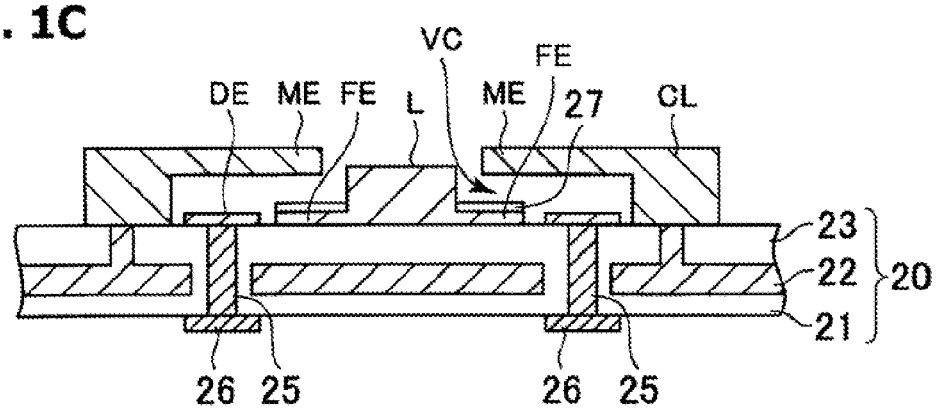

FIGS. 1B and 1C are a top view and a cross sectional view illustrating the structure of making variable an electric length of a variable transmission line.

As illustrated in FIG. 1B, movable electrodes ME are disposed above a line L. The number of movable electrodes ME may be increased or decreased when necessary. One movable electrode may be used. FIG. 1C is a cross sectional view taken along line IC-IC of FIG. 1B traversing a pair of movable electrodes ME. As illustrated in FIG. 1C, A transmission line L made of, e.g., copper is formed on a dielectric substrate 20. The transmission line L has a bottom portion wider than a top portion extending on both sides, and spaces for accommodating the movable electrodes ME of variable capacitors VC are secured above the extending portions. This structure may be formed by two plating steps using resist patterns with an opening for defining the external shape. The extending portions of the transmission line constitute the fixed electrode FE of the variable capacitor VC. An insulating layer 27 is formed on the upper surface of the extending portion to prevent short circuit and improve an effective dielectric constant. The insulating layer may be made of inorganic material or organic material. The insulating layer may be omitted in some cases.

The movable electrode ME is formed on a dielectric substrate 20, and is supported by a cantilever structure CL made of, e.g., copper. It may be considered that the top end portion of the cantilever CL constitutes the movable electrode ME. This structure may be formed by a plating process using a resist pattern with three dimensional structure, or by two plating processes using an opening for defining an external shape. A driving electrode DE is formed on the dielectric substrate 20 under the movable portion of the cantilever CL. The driving electrode may be formed at the same time when the extending portion of the transmission line is formed. The driving electrode may be formed of different metal material from the material of the transmission line in a different process. In this case, another process such as sputtering may be used.

The dielectric substrate 20 has such structure that a conductive metal layer 22 made of Ag or the like is formed on a ceramics layer 21 and another ceramics layer 23 is formed on the conductive metal layer 22. This structure may be formed by laminating a ceramics green sheet layer, a conductive layer (wiring layer), and a ceramics green layer in position alignment and sintering the lamination. The ceramics layer is further formed with metal vias for interlayer connection, and a high impedance resistor via for preventing leakage of a high frequency signal to a DC bias path. The dielectric constant of ceramics material may be selected in a range from about 3 to about 100. Via conductors are buried under the support portion of the cantilever CL, and under the drive electrodes DE. The cantilever CL is connected to the ground layer 22, and the drive electrode DE is connected to a terminal 26 formed on the bottom surface of the dielectric substrate 20 via a through via conductor 25. Pads for inputting and outputting an RF signal and a DC drive signal may be formed on the bottom surface of the dielectric substrate. These pads are connected to the structures on the substrate surface or wirings in the substrate via metal vias and high impedance resistor vias in the substrate.

In the structure illustrated in FIG. 1C, the movable electrode ME is connected to the ground layer. A DC voltage of about 10 V to 100 V is applied to the drive electrode DE. An electrostatic force attracts the movable electrode ME to the fixed electrode FE. An electric length of the transmission line L is determined by a variable capacitance of the variable capacitor VC and a circuit constant of the transmission line L. The electric length is able to be elongated by making the variable capacitance large.

Figure 1D:
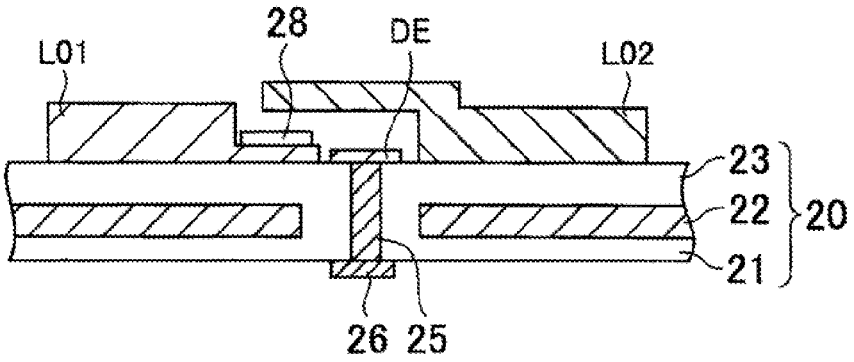
FIG. 1D is a cross sectional view of a variable capacitor serially connected to the transmission line.

FIG. 1D is a cross sectional view illustrating an example of the structure of variable capacitors C1, C2 and Cm connected to a communication line. A lower electrode line L01 having a projecting electrode on a bottom and an upper electrode line L02 having a projecting electrode on a top constitute a variable capacitor with the projecting electrodes being overlapped. A drive electrode DE is formed under the projecting electrode of the upper electrode line L02. An insulating film 28 is formed on the upper surface of the projecting electrode of the lower electrode line L01. The drive electrode DE is connected via the through via conductor 25 to a terminal 26 on the bottom surface of the dielectric substrate 20. The projecting electrode of the upper electrode line L02 has a cantilever structure, and is displaced downward by generating an electrostatic attraction force upon application of a DC voltage to the drive electrode. As an example of the variable capacitor, although an MEMS capacitor is illustrated in FIGS. 1B, 1C, and 1D, the variable capacitor is not limited to an MEMS capacitor.

Figure 1E:
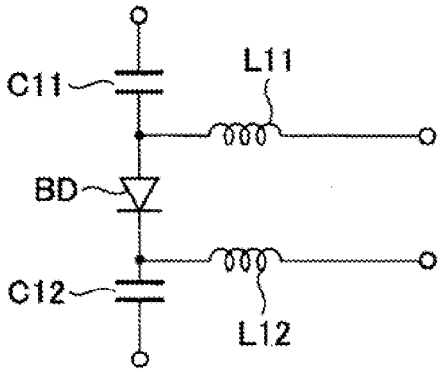
FIG. 1E is an equivalent circuit diagram of a variable capacitor using a varactor.

FIG. 1E illustrates a variable capacitor using a varactor. A capacitance of a varactor diode BD is changed with a reverse bias. Inductors L11 and L12 for applying a reverse bias and blocking a high frequency signal are connected to the anode and cathode of the varactor diode. Capacitors C11 and C12 are connected to the anode and cathode of the varactor diode BD to flow a high frequency signal through the varactor and cut a DC bias.

The MEMS variable capacitor is not limited to a cantilever structure. A variety of structures are possible.

Figure 1F:
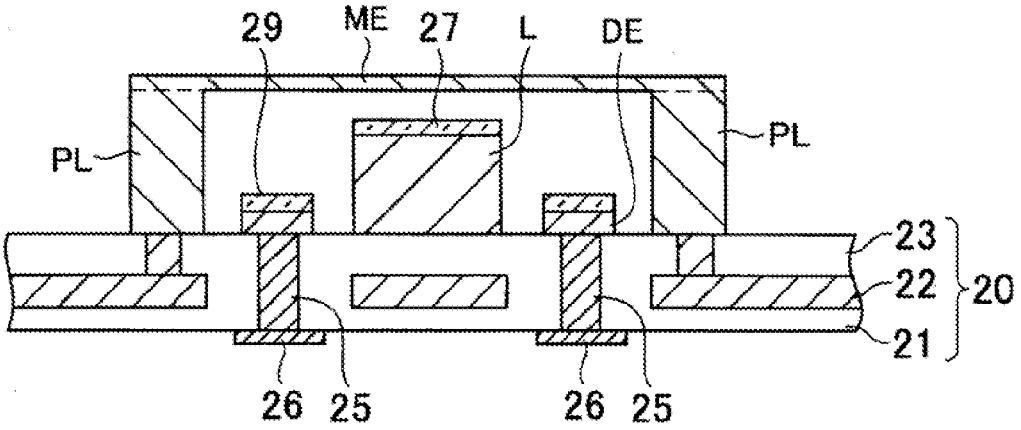
FIG. 1F is a cross sectional view of another example of a variable distributed constant type transmission line.

FIG. 1F illustrates an example of the structure of a variable filter of a both-side supported lever type. A pair of conductive support pillars PL is formed on a dielectric substrate 20, and a lever structure movable electrode ME is formed between the support pillars. A transmission line L is disposed on the dielectric substrate 20 under the movable electrode ME. Drive electrodes DE are formed on the dielectric substrate 20 on opposite sides of the transmission line L. Dielectric layers 27 and 29 are formed on the transmission line L and drive electrodes DE. The dielectric layers 27 and 29 on the drive electrode DE may be omitted. The structure inside the dielectric substrate 20 is similar to that of the structure illustrated in FIG. 1C.

Figure 2A:
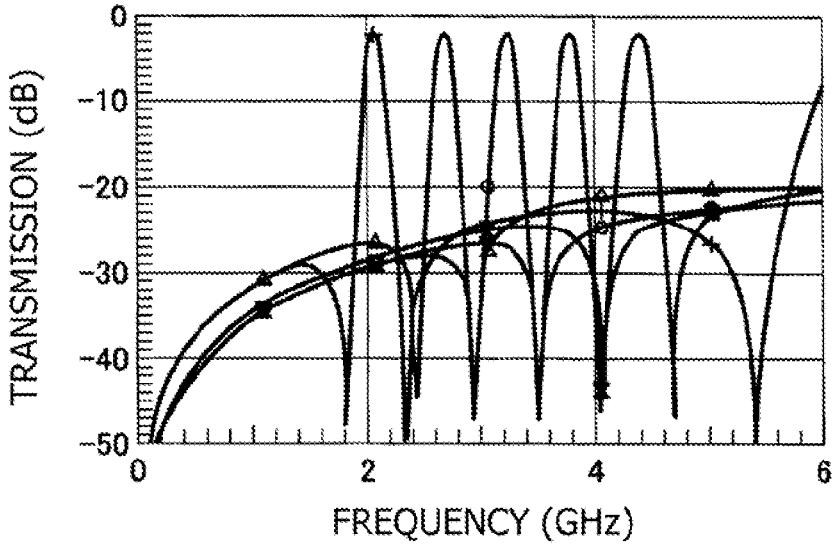
FIG. 2A is a graph illustrating a change in the pass band when a total electric length of the input and output side resonators of the variable filters of the first embodiment is changed.

FIG. 2A is a graph illustrating a change in the pass characteristics of a variable filter when an electric length of the transmission line is elongated by applying a DC voltage to the variable capacitors of the transmission lines L1, L2, and LC1 in the structure of FIG. 1A. The abscissa represents a frequency in the unit of GHz, and the ordinate represent a transmission factor in the unit of dB. One example illustrates the filter pass characteristics when an applied voltage is increased from 0 V to 80 V at a step of 20 V. The center frequency of the pass band changes from about 4.4 GHz to about 2.06 GHz.

Figure 2B:
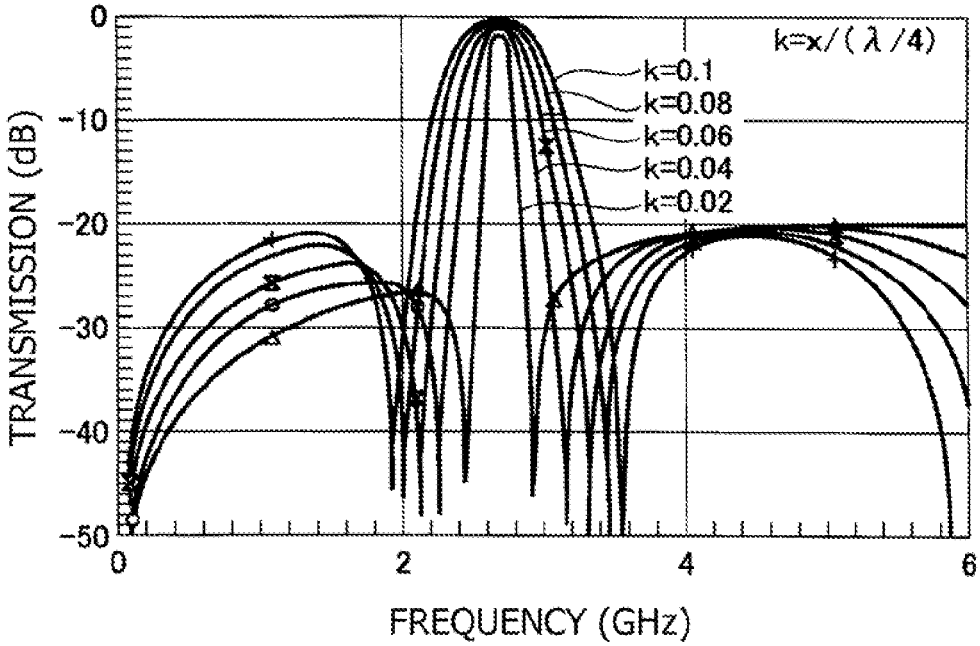
FIG. 2B is a graph illustrating a change in the pass band when a ratio k of an electric length x of a coupling portion to $\lambda/4$ ($\lambda$: wavelength) is changed.

FIG. 2B is a graph illustrating a change in the pass band of a variable filter of the structure illustrated in FIG. 1A when a coupling coefficient k is changed. The coupling coefficient k is a ratio of x to a quarter wave length ($\lambda/4$), $k=x/(\lambda/4)$, when an electric length of the coupling line is $(\lambda/4)+x$, and the electric lengths of the lines L1 and L2 are $(\lambda/4)-x$. As the coupling coefficient k becomes small from 0.1 to 0.02, the pass band width becomes narrow.

Figure 2C:
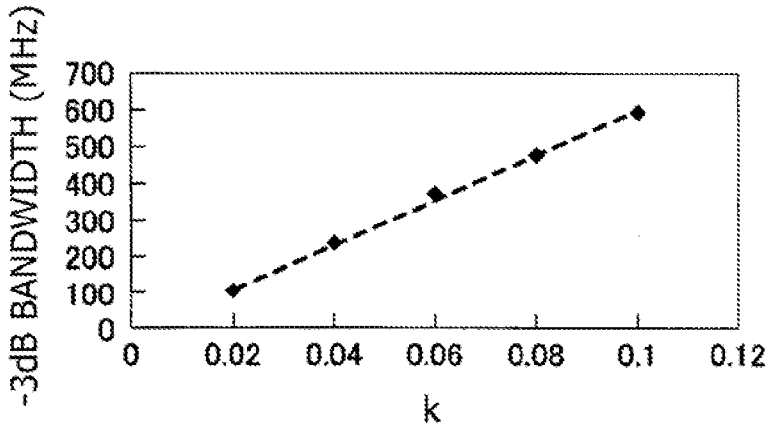
FIG. 2C is a graph illustrating a change in a −3 dB band width relative to a change in k.

FIG. 2C is a graph illustrating a change in a −3 dB band width relative to a change in the coupling coefficient k. The −3 dB band width is a width of a band indicating a −3 dB change from the peak. It indicates that as the coupling coefficient k increases, the band width increases linearly.

It is seen from these graphs that the center frequency and band width of the pass band are able to be controlled by changing the coupling capacitances of the transmission lines L1, L2, and LC1 of the circuit of FIG. 1A. For example, it is easy to know a drive voltage to be applied to a drive electrode to obtain a desired center frequency and band width by using a lookup table indicating the center frequency and band width of a pass band as a function of an application voltage to obtain each coupling capacitance or capacitance value of the transmission lines L1, L2, and LC1.

It is possible to adjust both the center frequency and pass band width of a pass band.

In the first embodiment, the electric length of the coupling portion transmission line LC1 is $(\lambda/4)+x$ having a long physical length of the transmission line. It is preferable if a more compact structure is possible.

Figure 3A:
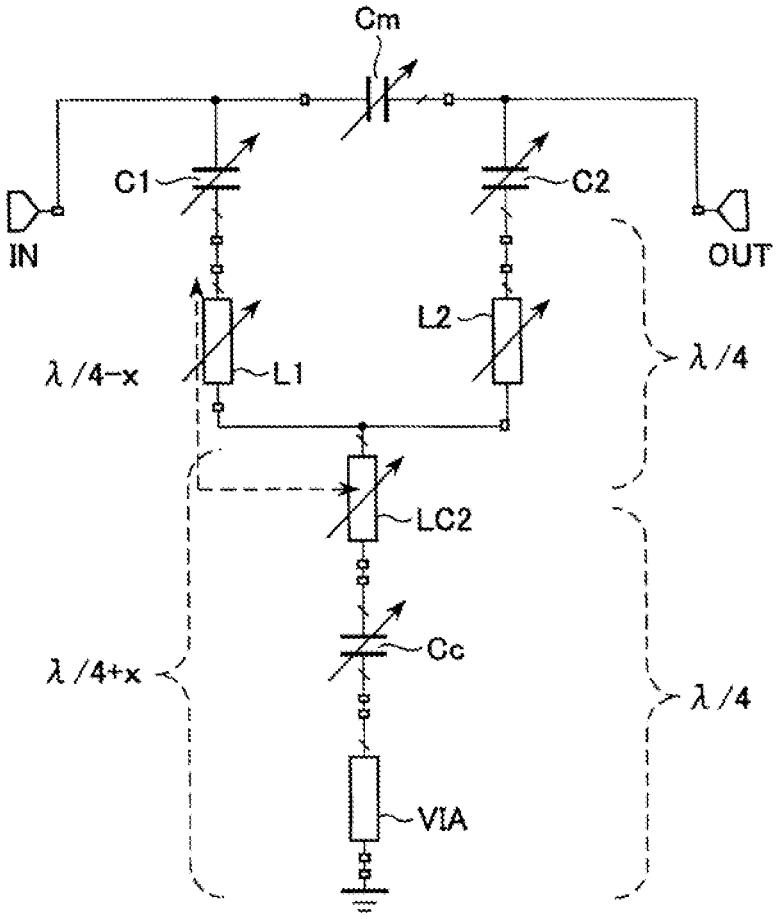
FIG. 3A is an equivalent circuit diagram of a variable filter of the second embodiment.

FIG. 3A is an equivalent circuit of a variable filter of the second embodiment. Description will be made mainly on different points from the first embodiment. The transmission line LC1 with the open end of the first embodiment is replaced with a serial connection of a coupling portion third transmission line LC2, a variable capacitor Cc and a line VIA constituted of a via conductor. The other end of the line VIA is grounded. A total electric length of the coupling portion is $(\lambda/4)+x$. The branch portion is similar to the first embodiment, and an electric length of each resonator is $(\lambda/4)-x$. By introducing the variable capacitor Cc, the electric length of the transmission line LC2 is able to be shortened.

Figure 3B:
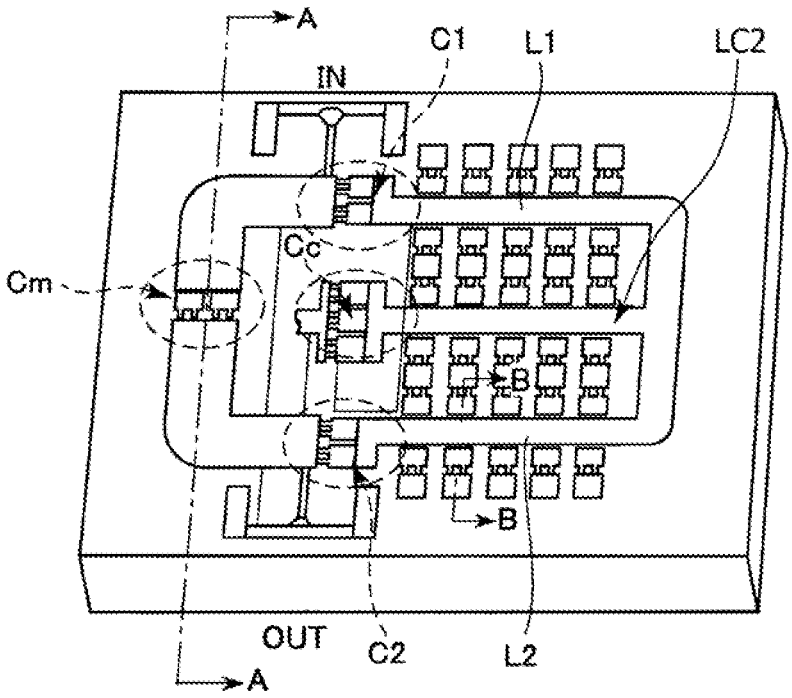
FIG. 3B is a top perspective view illustrating an example of the structure realizing the circuit of FIG. 3A.
Figure 4:
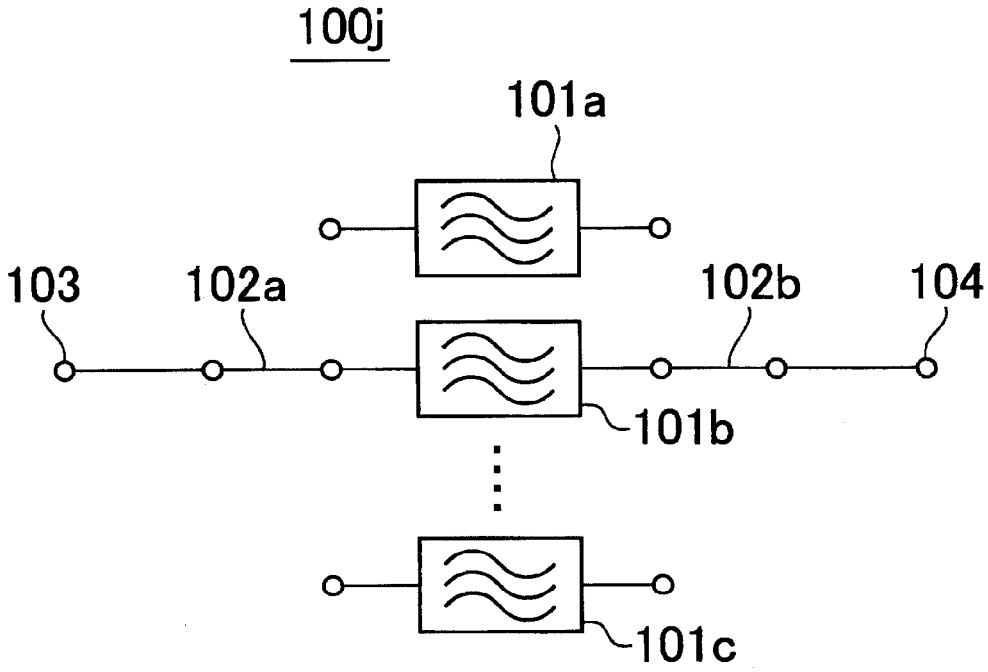
FIG. 4 RELATED ART
FIG. 4 is an equivalent circuit diagram of a conventional frequency variable filter.

FIG. 3B is a perspective top view of an example of the structure realizing the circuit of FIG. 3A. A serial connection of a variable capacitor C1 and a transmission line L1 is connected to an input terminal IN. A serial connection of a variable capacitor C2 and a transmission line L2 is connected to an output terminal OUT. Electrodes of a variable capacitor Cm connect the variable capacitors C1 and C2. The transmission lines L1 and L2 are connected to a transmission line LC2 of a coupling portion. The other end of the coupling portion transmission line is grounded via a variable capacitor Cc and a via conductor. A variable capacitor is formed at upper five positions of each of the transmission lines L1, L2, and LC2. A cross section along line A-A has, e.g., the structure of FIG. 1D. A cross section along line B-B has, e.g., the structure of FIG. 1C. The structure of the variable capacitor C1, C2 has, e.g., the structure of FIG. 1D.

A glass epoxy substrate may be used in place of a ceramics substrate. All examples and conditional language recited herein are intended for pedagogical purposes to aid the reader in understanding the invention and the concepts constituted by the inventor to furthering the art, and are to be construed as being without limitation to such specifically recited examples and conditions, nor does the organization of such examples in the specification related to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A variable filter comprising:

a dielectric substrate having a ground conductor therein;

an input terminal formed on the dielectric substrate;

an output terminal formed on the dielectric substrate;

a first resonator including a first transmission line, a first end thereof being connected to the input terminal;

a second resonator including a second transmission line, a first end thereof being connected to the output terminal;

a coupling portion including a coupling transmission line, having a first end connected to a second end of the first resonator and a second end of the second resonator and the coupling portion having a second end being an open end, or the coupling portion including a serial connection of the coupling transmission line and a variable capacitor, the serial connection having the first end connected to the second ends of the first and second resonators, and the coupling portion having the second end connected to the ground conductor; and adjusting means capable of changing an electric transmission length, in the first, second and coupling transmission lines;

wherein a pass band width is able to be changed by changing a ratio of the electric transmission length of the coupling transmission line to a summation of the electric transmission lengths of the first and second resonators and the coupling portion, and wherein said adjusting means includes at least one variable capacitance, each of the at least one variable capacitance constituted of a first, second or coupling fixed electrode formed on said dielectric substrate and connected to the corresponding first, second or coupling transmission line, a first, second or coupling drive electrode formed on said dielectric substrate, and a first, second or coupling movable electrode connected to said ground conductor and extending above said corresponding first, second or coupling fixed electrode and said corresponding first, second or coupling drive electrode.

2. The variable filter according to claim 1, wherein the first resonator includes a serial connection of a first variable capacitance and the first transmission line, the second resonator includes a serial connection of a second variable capacitance and the second transmission line, and said coupling portion includes the serial connection of the coupling transmission line and the variable capacitor in which the variable capacitor has one end connected to coupling transmission line, wherein the coupling transmission line is of a distributed constant type, and another end of the variable capacitor is connected to the ground conductor through a via conductor buried in the dielectric substrate.

3. The variable filter according to claim 1, wherein said at least one variable capacitance of said adjusting means includes a first variable capacitance including the first fixed electrode connected to the first transmission line of the first resonator, the first drive electrode, and the first movable electrode connected to the ground conductor and the first movable electrode extending above the first fixed electrode and the first drive electrode, a second variable capacitance including the second fixed electrode connected to the second transmission line of the second resonator, the second drive electrode, and the second movable electrode connected to the ground conductor and the second movable electrode extending above the second fixed electrode and the second drive electrode, and a third variable capacitance including the third fixed electrode connected to the coupling transmission line of the coupling portion, the third drive electrode, and the third movable electrode connected to the ground conductor and the third movable electrode extending above the third fixed electrode and the third drive electrode.

4. The variable filter according to claim 1, wherein said dielectric substrate is made of low temperature co-fired ceramics.

5. The variable filter according to claim 1, further comprising an inter-stage capacitor coupling the input terminal and the output terminal.

6. The variable filter according to claim 5, wherein said inter-stage capacitor is a variable capacitor.

7. The variable filter according to claim 6, wherein said variable capacitor of the inter-stage capacitor includes a fixed electrode formed on said dielectric substrate and connected to one of the first and second transmission lines, a drive electrode formed on said dielectric substrate, and a movable electrode connected to the other of the first and second transmission lines and extending above said fixed electrode and said drive electrode.

8. The variable filter according to claim 6, wherein said variable capacitor of the inter-stage capacitor includes a varactor.

9. The variable filter according to claim 1, wherein said first resonator includes a serial connection of a first impedance matching variable capacitor and the first transmission line, and said second resonator includes a serial connection of a second impedance matching variable capacitor and the second transmission line.

10. The variable filter according to claim 9, wherein at least one of said first and second impedance matching variable capacitors includes a varactor.

11. The variable filter according to claim 9, wherein at least one of said first and second impedance matching variable capacitors includes a fixed electrode formed on said dielectric substrate and connected to the corresponding first or second transmission line, a drive electrode formed on said dielectric substrate, and a movable electrode connected to the corresponding first or second transmission line and extending above said fixed electrode and said drive electrode.

12. A communication apparatus including a variable filter, the variable filter comprising:

a dielectric substrate having a ground conductor therein;

an input terminal formed on the dielectric substrate;

an output terminal formed on the dielectric substrate;

a first resonator including a first transmission line, a first end thereof being connected to the input terminal;

a second resonator including a second transmission line, a first end thereof being connected to the output terminal;

a coupling portion including a coupling transmission line, having a first end connected to a second end of the first resonator and a second end of the second resonator and the coupling portion having a second end being an open end, or the coupling portion including a serial connection of the coupling transmission line and a variable capacitor, the serial connection having the first end connected to the second ends of the first and second resonators, and the coupling portion having the second end connected to the ground conductor; and adjusting means capable of changing an electric transmission length, in the first, second and coupling transmission lines;

wherein a pass band width is able to be changed by changing a ratio of the electric transmission length of the coupling transmission line to a summation of the electric transmission lengths of the first and second resonators and the coupling portion, and wherein said adjusting means includes at least one variable capacitance, each of the at least one variable capacitance constituted of a fixed electrode formed on said dielectric substrate and connected to the corresponding first, second or coupling transmission line, a drive electrode formed on said dielectric substrate, and a movable electrode connected to said ground conductor and extending above said fixed electrode and said drive electrode.

13. A variable filter comprising:

a dielectric substrate having a ground conductor therein;

an input terminal formed on the dielectric substrate;

an output terminal formed on the dielectric substrate;

a first resonator including a serial connection of a first impedance matching variable capacitor and a first transmission line, a first end thereof being connected to the input terminal;

a second resonator including a serial connection of a second impedance matching variable capacitor and a second transmission line, a first end thereof being connected to the output terminal;

a coupling portion including a coupling transmission line, having a first end connected to a second end of the first resonator and a second end of the second resonator and the coupling portion having a second end being an open end, or the coupling portion including a serial connection of the coupling transmission line and a variable capacitor, the serial connection having the first end connected to the second ends of the first and second resonators, and the coupling portion having the second end connected to the ground conductor; and adjusting means capable of changing an electric transmission length, in the first, second and coupling transmission lines;

wherein a pass band width is able to be changed by changing a ratio of the electric transmission length of the coupling transmission line to a summation of the electric transmission lengths of the first and second resonators and the coupling portion, and wherein at least one of said first and second impedance matching variable capacitors includes a varactor.

* * * * *